US005839824A

United States Patent [19]

Backman et al.

[11] Patent Number: 5,839,824

[45] Date of Patent: Nov. 24, 1998

[54] CONCRETE MIXER

[76] Inventors: James A. Backman, 4887 Sutton La., Greendale, Wis. 53129; Todd A. Sherbinow, 613 N. West Ave., Waukesha, Wis. 53186

[21] Appl. No.: 614,961

[22] Filed: Mar. 11, 1996

[51] Int. Cl.[6] ..... B28C 5/20; B01F 9/06

[52] U.S. Cl. ..... 366/59; 366/57; 366/227; 366/229

[58] Field of Search ..... 366/54, 57, 59, 366/56, 225, 226, 227, 228, 229, 230, 231

[56] References Cited

U.S. PATENT DOCUMENTS

| | | | |
|---|---|---|---|
| Re. 19,085 | 2/1934 | Jaeger | 366/57 |
| 1,370,954 | 3/1921 | Ebersold | 366/59 |
| 1,500,322 | 7/1924 | Ionides | 366/57 |
| 1,734,981 | 11/1929 | Philips | 366/57 |
| 1,746,481 | 2/1930 | Ketchey | 366/57 |
| 1,901,305 | 3/1933 | Knowles | 366/57 |

FOREIGN PATENT DOCUMENTS

| | | | |
|---|---|---|---|
| 26753 | 8/1954 | Finland | 366/59 |
| 37752 | 1/1931 | France | 366/59 |
| 133617 | 4/1901 | Germany | 366/57 |
| 802322 | 2/1951 | Germany | 366/59 |
| 129220 | 8/1927 | Switzerland | 366/59 |
| 10059 | 6/1904 | United Kingdom | 366/59 |
| 281889 | 12/1927 | United Kingdom | 366/57 |
| 384566 | 12/1932 | United Kingdom | 366/59 |
| 922980 | 4/1963 | United Kingdom | 366/57 |

*Primary Examiner*—Tony G. Soohoo
*Attorney, Agent, or Firm*—Wheeler Kromholz & Manion

[57] ABSTRACT

A concrete mixer including a mixing shell and a void located therein for receiving material to form concrete. The concrete mixing mechanism having a first blade mechanism spatially orientated to have a pitch capable of moving at least a portion of the material in a first predetermined direction and a second blade mechanism spatially orientated to have a pitch capable of moving at least a portion of the material in a second predetermined direction.

18 Claims, 5 Drawing Sheets

SECTION "A-A"

CONCRETE MIXER

BACKGROUND OF THE INVENTION

The present invention is generally related to mixing machines and specifically related to machines for mixing concrete. The inventors know of no prior art which teaches the unique structure and method disclosed herein.

A concrete mixer may generally be defined as a machine in which cement, sand, gravel, and water are combined to make concrete. These types of machines are sometimes called cement mixers although that term is not entirely accurate since cement is a component of concrete. Concrete is essentially a construction material consisting of conglomerate, pebbles, broken stone, or slag in a mortar or a cement matrix. There are a great many materials which are suitable for the formation of concrete.

Concrete, by its nature, is generally made in batches in a concrete mixer. Since concrete is a basic construction material, the rate at which each batch of concrete may be produced in turn defines the rate at which a construction job may take place. For example in a presently known concrete mixer, a concrete mixture comprising 500 to 600 pounds of cement, 1500 pounds of sand, 1700 to 1800 pounds of stone, 200–250 pounds of water and a few ounces of known admix may typically be thoroughly mixed and ready to use as concrete after approximately 60 seconds of mixing wherein the approximate 40 cubic feet of the separate mixed components is reduced to 27 cubic feet of concrete mixture. The present invention, by means of its unique and simple design and method reduces the mixing time for mixing a concrete mixture by at least 40 percent. This provides a substantially economic advantage in the marketplace. This would allow a 12 yard mixer to produce batches at almost two times the rate heretofore possible. This will allow a commensurate savings in time on construction projects where such a mixer is employed.

Furthermore, by reducing the mixing time for producing the concrete, the present invention also reduces the energy consumed by the operation of the concrete mixer, reduces blade and drum wear by reducing the amount of time the concrete mixer has to be run, and provides optimum mixing conditions to achieve the requirements or specification of the desired concrete mixture produced.

Accordingly, it is the objective of the present invention to provide a concrete mixer design and method which significantly reduces the time required to mix concrete and thereby achieve enhanced concrete production to enhance the speed of the completion of a particular project while at the same time also achieving the objectives of reducing energy consumption, reducing blade wear and drum wear, and providing optimum mixing conditions to achieve the specification requirements of the particular concrete mixture.

SUMMARY OF THE INVENTION

The invention is essentially a concrete mixer or concrete mixing mechanism. The concrete mixer is generally composed of a mixing shell which includes a void located therein for receiving the materials required to form concrete. The present invention comprising at least a first blade mechanism and at least a second blade mechanism combined and oriented in a predetermined manner. The first blade mechanism and the second blade mechanism being mounted in the void. The first blade mechanism having a pitch and spatially orientated in the void so that the blade is capable of moving at least a portion of material in a first predetermined direction. The second blade mechanism also having a pitch and being spatially orientated so that it is capable of moving at least a portion of the material in a second predetermined direction. This is to create mixing movement within the materials placed into the void of the mixer and thereby increase the speed of the mixing.

Alternatively, the mixer could be described structurally as a concrete mixer for mixing a predetermined group of materials to form concrete. The mixer structurally comprising a shell having a void. Within the void, a first helical mixing mechanism being mounted and a second helical mixing mechanism being mounted. The first helical mixing mechanism and the second helical mixing mechanism extending in substantially opposite directions through the void.

Consequentially, it is the goal of the present invention to provide a mixing structure wherein the materials necessary to form concrete are mixed by blade mechanisms or equivalent mixing mechanisms in a manner which causes a counter flow or enhanced mixing action of the material. The present invention achieves this by at least providing sufficient blade mechanisms pitched to produce this mixing action.

The present invention, accordingly, may also preferably include blade mechanisms which are helical in shape so that, for example, the first blade mechanism is essentially a right handed helix and the second blade mechanism is essentially a left handed helix. The blades may be of a single unitary structure or they may be composed of a plurality of paddles mounted in a helical fashion in the void of the shell of the concrete mixer.

The blades may be mounted either to the inner surface of the shell of the concrete mixer or they may be mounted to a shaft extending through the concrete mixer. Alternatively, one blade could be mounted to a shaft while the other blade structure is mounted to the interior surface of the concrete mixer.

Typically, the void is essentially a passageway which extends through the shell to define a mixing area having a charging end opening and a discharge end opening. However, a mixer for mixing concrete could have only one opening through which material is added to the mixer and from which the material, after being mixed, is discharged. It is commercially preferred, at the present time, for the mixer of the present invention to have a charge end opening and a discharge end opening.

The pitch given the blades may be any pitch that is desired. But the present invention is believed to operate most effectively when one blade mechanism is defined to have an outside edge and an inside edge such that the outside edge of the blade mechanism is circumjacent to an axis which extends through the center of the void from the discharge end of the mixer to the charge end of mixer and forms an angle of approximately 45 degrees where the outside edge crosses the central axis of the mixer. Further, it is preferred that the inside edge of the blade mechanism, also circumjacent to the axis of the mixer, cross that axis at an angle of approximately 39 degrees. Additionally, it is preferred that the other blade mechanism, also having an outside edge and an inside edge which are circumjacent to the central axis, be of such form that the outside edge of the other blade mechanism crosses the central axis at an angle of 38 degrees and the inside edge cross the central axis at an angle of 22 degrees.

The angles and the pitch of the blade mechanism are desired to be sufficient to create an enhanced mixing action of the concrete materials in the mixer. It is desired to create a relative motion of material in the mixer that is enhanced so that the counter flow of materials back and forth quickly results in a thorough mixture of the concrete material so that it may be used.

Finally, the present invention may simply be expressed as a method for mixing concrete using a concrete mixer having a mixing shell including a void for receiving materials capable of being mixed to form concrete. The concrete mixer for use in this method includes a first blade mechanism and a second blade mechanism. Each blade mechanism is mounted in the void of the mixer. The first blade mechanism is substantially helical in shape and capable of moving at least a portion of the materials in a first predetermined direction. The second blade mechanism is substantially helical in shape and capable of moving at least a portion of materials in a second predetermined direction, that is to say a predetermined direction that is different from the first predetermined direction. The method simply comprising pouring the materials into the mixer. Then mixing the materials for a predetermined period of time, followed by discharging the materials from the concrete mixer so they may be used.

DESCRIPTION OF THE DRAWINGS

FIG. 1 is a side elevational view showing the present invention in use in conjunction with one of the many types of plant designs in which it may be used in conjunction with.

DETAILED DESCRIPTION

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

Figure 1:
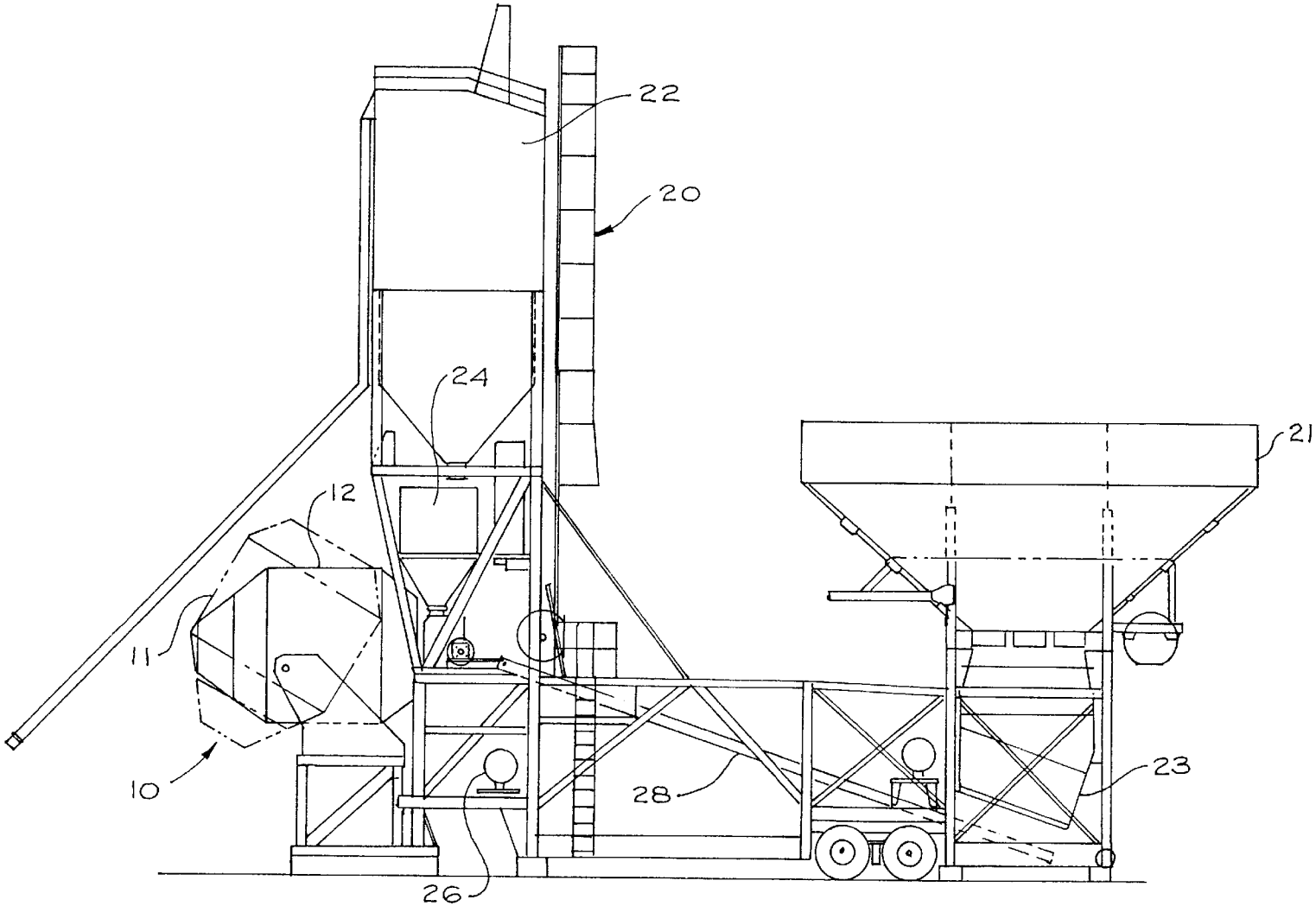

The present invention is a concrete mixer 10 for use in conjunction with a concrete plant 20. The concrete plant 20 may be of any desired type. The concrete plant 20 shown in FIG. 1 is one possible type of plant 20 which may be used in conjunction with this mixer 10. The plant 20 shows the typical features of a concrete plant 20 which may be used in conjunction with this concrete mixer 10 although other configurations may be used as is desired or necessary for the particular project wherein the concrete will be used.

The presently disclosed plant 20 may generally be seen to be comprised of the concrete mixer of the present invention 10, a cement material measurement structure 24, an aggregate supply 21, cement storage 22, aggregate material measurement structure 23, a conveyor 28 for moving the aggregate from the aggregate supply area into position for loading into the concrete mixer 10 and a water supply 26. The concrete mixer 10 in the plant configuration 20 shown in FIG. 1 has a charge position 12 and a discharge position 11. The charge position 12 is for loading the desired components of the concrete mixture into the concrete mixer 10 and mixing those components while the discharge position 11 is for off loading or discharging the mixed concrete so that it may be used or delivered to a place where it may be used.

Figure 2:
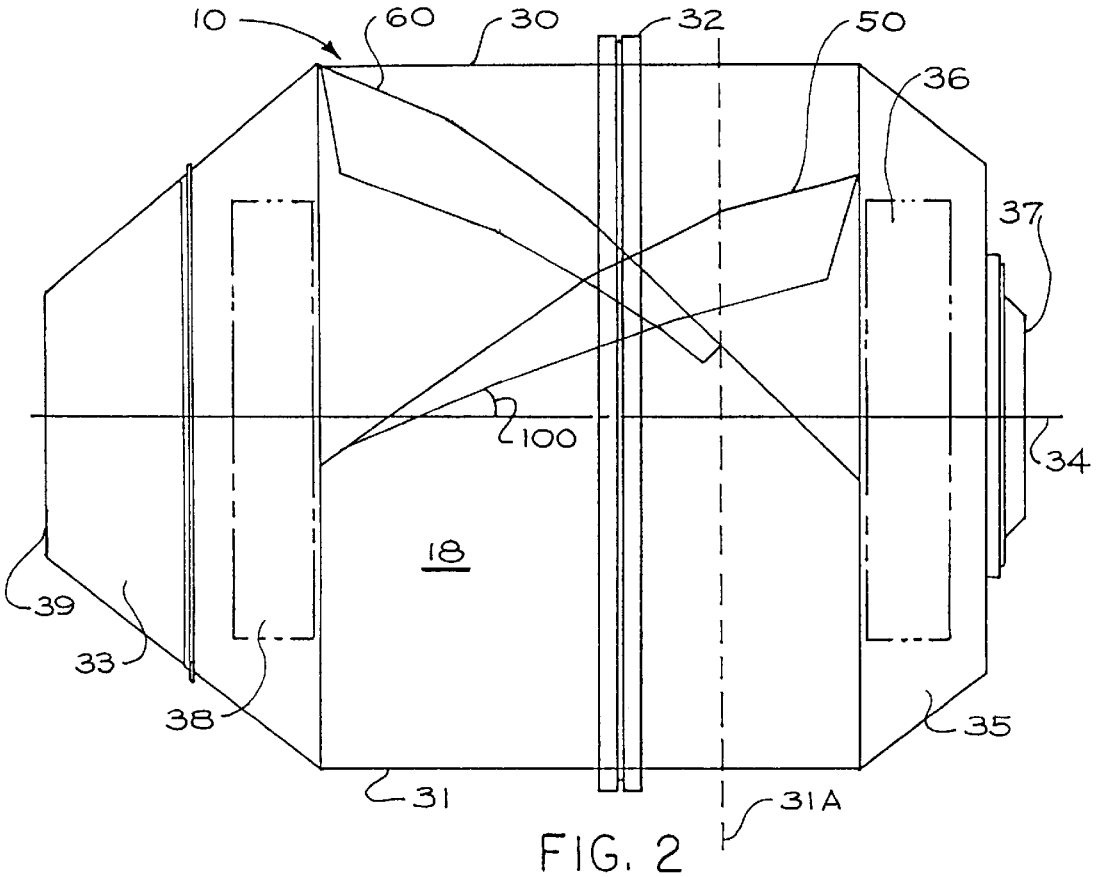
FIG. 2 is a cutaway side elevational plan view of the present invention.
Figure 2A:
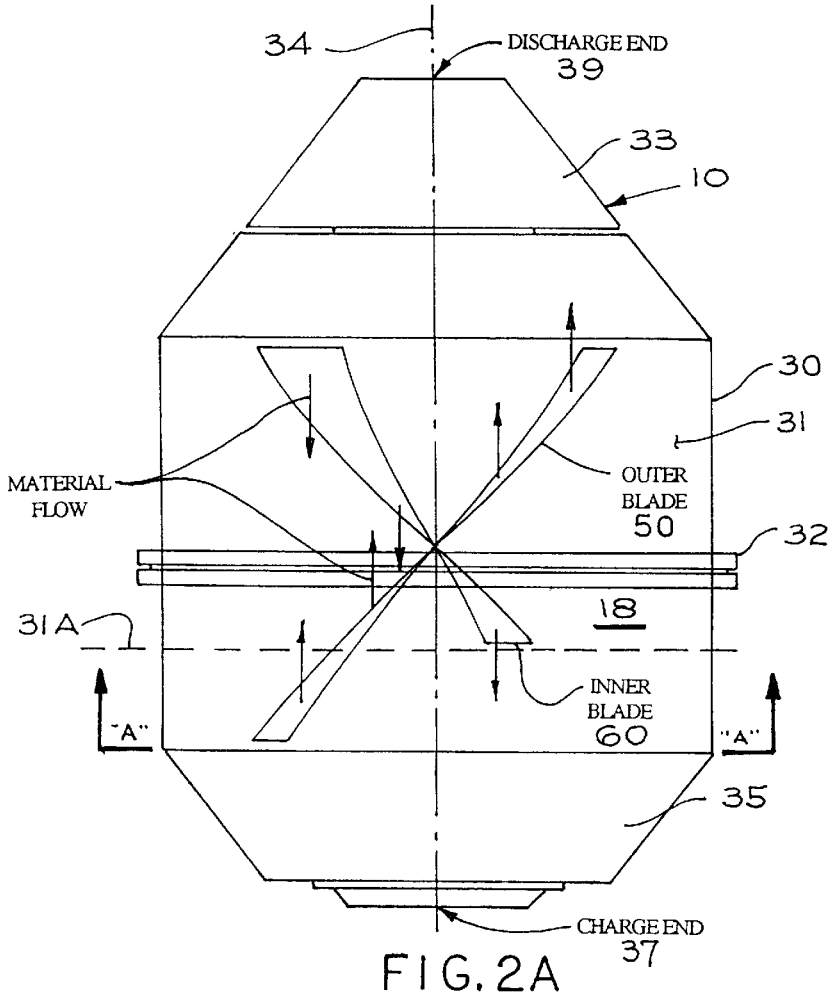
FIG. 2A is a side elevational view of the concrete mixer of the present invention showing the direction of the blade mechanisms in greater detail. This view shows the commercially preferred embodiment.
Figure 2B:
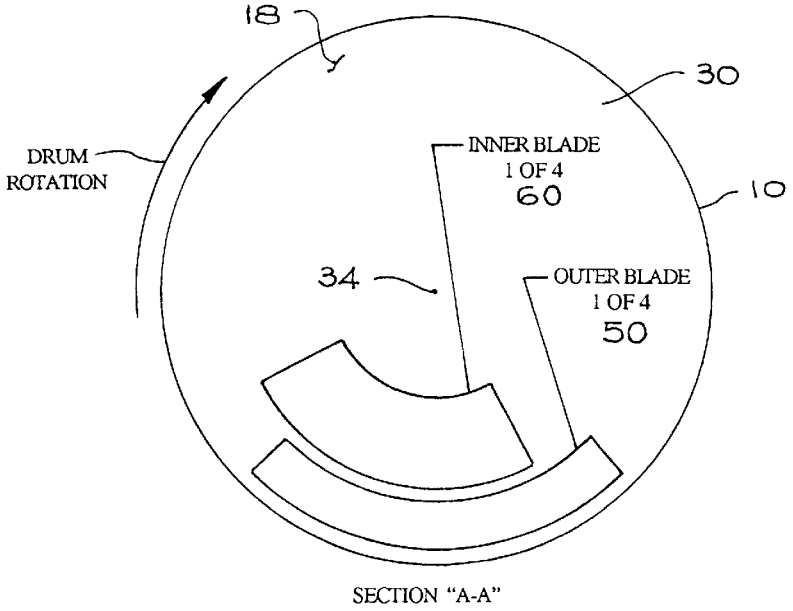
FIG. 2B is a view from line A—A of FIG. 2A.

Referring to FIG. 2 and FIG. 2A, the concrete mixer 10 may be seen to generally include a shell 30 having a central shell structure 31, a charge end structure 35, and a discharge end structure 33. A central axis 34 extends from a charge end opening 37 to a discharge end opening 39. Known discharge end paddles 38 are located at discharge end 33 while known charge end paddles 36 are located at charge end 35. Within the area defined by the central shell structure 31 the outside blade structure 50 and the inside blade structure 60 may be seen. Although only one outside blade structure 50 and one inside blade structure 60 are shown it is preferred in the present commercial embodiment that there be 8 blade structures used. Four outside blade structures 50 and 4 inside blade structures 60. These blade structures are mounted so that each outside blade structure 50 is mounted equidistant from every other outside blade structure 50 and each inside blade structure 60 is mounted equidistant from each inside blade structure 60. Preferably the blade structures 60 are mounted by welding or any other suitable attachment means to the inside surface 70 (See FIGS. 5 and 6 of the central shell structure 31). Finally, the concrete mixer 10 of the present invention may be seen to include a ring gear 32 which is engaged with a known drive mechanism (not shown) for turning the mixer to cause the mixing action within the void area 18 of the central shell structure 31.

Still referring to FIG. 2, the discharge end paddles 38 and the charge end paddles 36, while known structures are believed to be commercially desirable, because they aid in preventing the concrete materials from inadvertently leaving the mixing area of void 18 during the mixing process. Additionally, referring to FIGS. 2 and 2A it should be noted that it is preferred that the inside blade structure 60 extend from the discharge end structure 33 to a predetermined location located along line 31A that is approximately two feet from the charge end 35 of the concrete mixing structure 10 where the concrete mixing structure 10 is a 12 yard concrete mixer having a drum length (i.e., central shell structure 31 length) of 7½ feet. The outside blade structure 50 is preferred to extend from the charge end 35 to the discharge end 33. This is believed preferred since it has been found that extending the inside blade structure 60 to the charge end structure 35 prevents the materials for making concrete from sufficiently entering the shell structure 30 where they can be effectively mixed. Alternatively, rather than not extending the inside blade structure 60 to the charge end structure 30 the pitch of the inside blade structure 50 blades could be changed so as to initially aid in the movement of the material from the charge end 35 into the central shell structure 31.

It should be understood that the purpose of the outside blade structure 50 and the inside blade structure 60 is to provide two separate blade structures of opposing pitch capable of moving the materials to be mixed in two different directions. Ideally a counter flow of material occurs within the central shell structure 31. This is believed to have the affect of dramatically increasing the relative motion of the materials to be mixed within the central shell structure 31 while at the same time not requiring any additional energy being spent in the mixing process. Typically, the mixer 10 is kept in a horizontal position during the mixing process and then tipped into a non-horizontal position so that the material after it has been mixed may be discharged.

Figure 3:
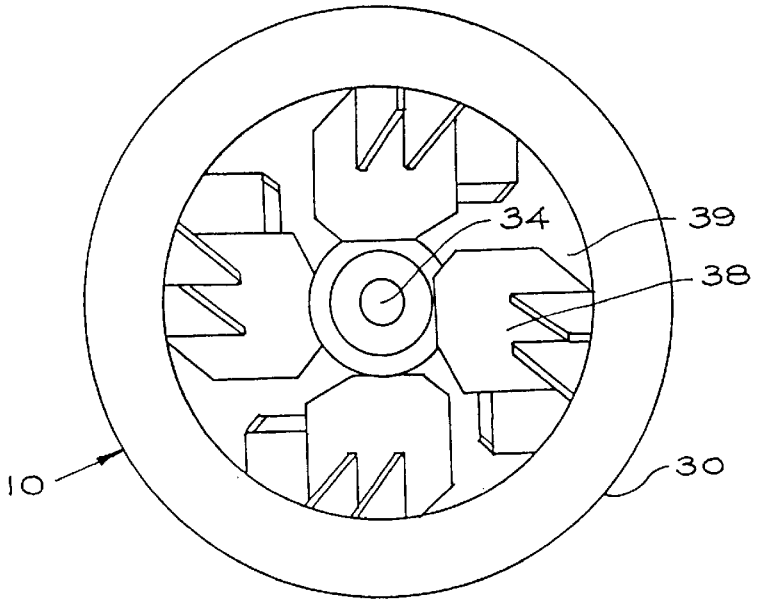
FIG. 3 is an end elevational view of the present invention from the discharge end of the mixer of the present invention.

Referring now to FIG. 3, the concrete mixer 10 may be seen from the discharge end opening 38. The central axis 34 may be seen to illustrate an axis extending through the center of the shell 30 of the concrete mixer. Discharge paddles 38 are illustrated. Discharge paddles 38 are essentially identical to charge end paddles 36. Both the structure of discharge paddles 38 and charge end paddles 36 are known in the prior art.

Figure 4:
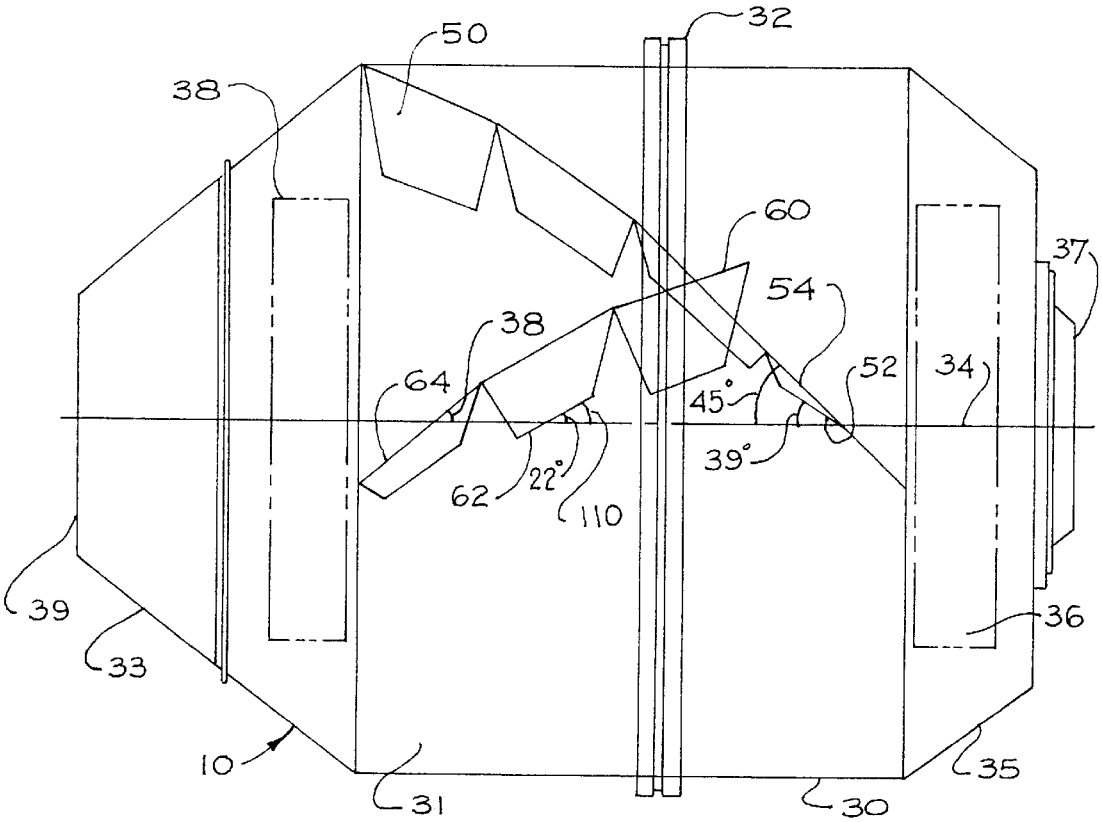
FIG. 4 is a side elevational cutaway plan view of an alternative embodiment of the present invention.

Referring now to FIG. 4 an alternative structure of the concrete mixer 10 may be seen. In particular, the alternative structure disclosed in FIG. 4 illustrates that the outside blade structure 50 and the inside blade structure 60 may, instead of being comprised of one continuous blade structure 50 or 60 as disclosed in FIGS. 2 and 2A comprise a plurality of blade structures or paddles mounted within the shell 30 to also present a left hand helix and a right hand helix blade structure for counter flow mixing. The outside blade structures 50 and the inside blade structures 60 disclosed in FIGS. 2, 2A, and 4 are helical in nature and pitched to move the materials for mixing in counter flow directions. This type of mixing has presently shown an improvement of at least 40 percent in the time necessary to mix the concrete from the constituent materials required to form the concrete and thus enhance the efficiency of the concrete mixing operation.

Referring now to FIGS. 2 and 4 the inside blade 60 and the outside blade 50 may be seen to cross the center line at angles 100 and 110 in FIGS. 2 and 4 respectively. Each blade structure should be pitched to move the materials in a desired direction and it is preferred, although not required, that, with respect to the outside blade 50 that the outside edge 54 of the outside blade 50 cross the axis 34 at an angle of 45 degrees and that the inside edge 52 cross the axis at an angle of 39 degrees while the outside edge 64 of the inner blade 60 cross the axis 34 at an angle of 38 degrees and the inside edge 62 of the inner blade 60 cross the axis 34 at an angle of 22 degrees. It being understood that the inside blade structure 60 and the outside blade structure 50 are substantially helical in shape and pitched so that they are three dimensional, approximate, mirror images of each other; e.g., the inner blade structure 60 and the outer blade structure 50 being generally described as a left hand helix and a right hand helix. The inner blade structure 60 and the outside blade structure 50 being understood to be circumjacent to the central axis 34 of the concrete mixer 10.

Figure 5:
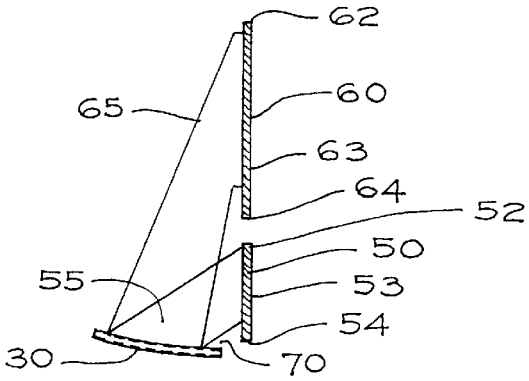
FIG. 5 is a side elevational view of the blade mechanisms of the present invention at the point where the two blade mechanism would intersect adjacent to each other within the void of the concrete mixer.

Referring now to FIG. 5, the cross section of the inside blade structure 60 and the outside blade structure 50 is illustrated and show the inside blade structure 60 and the outside blade structure 50 mounted to the inside surface 70 of the shell 30 of the concrete mixer 10. The inside blade structure 60 may be seen to be comprised of a paddle 63 coupled to a support post 65 which extends from the inside surface 70 of the concrete mixer 10 mixing shell 30. The paddle 63 has an inside edge 62 and an outside edge 64. The outside blade structure 50 also is illustrated and shown to comprise a paddle 53 coupled to a post 55 which also extends from the inside surface 70 of the shell 30 of the concrete mixing structure. The paddle 53 also includes an outside edge 54 and an inside edge 52.

Figure 6:
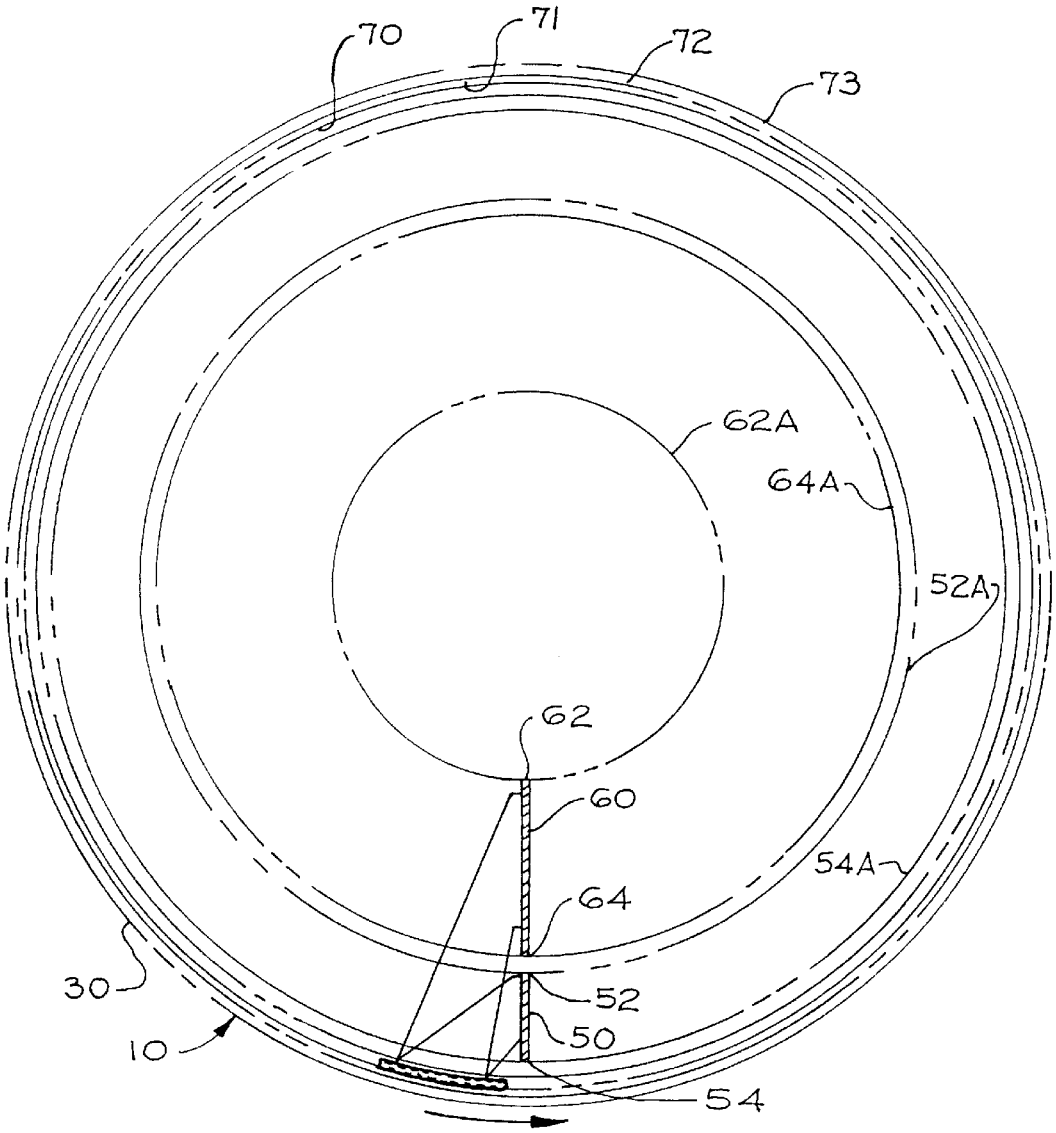
FIG. 6 is a schematic view showing the intersection described in FIG. 5 and the relative position of the outside and inside edges of each mixing blade.

Referring now to FIG. 6 the outside blade structure 50 and the inside blade structure 60 are illustrated from the discharge end 33 of the concrete mixer 10 showing the outside blade structure 50 and the inside blade structure 60 circumjacent to the axis 34. The shell 30 of the mixer 10 may be seen to be comprised of an inside surface 70 which is normally a poly liner, an inside steel liner 71, an inside drum 72, and an outside drum 73. Phantom line 62*a* shows the path of travel of inside edge 62 of the inside blade structure 60 around axis 34. Line 64*a* shows the path of travel of outside edge 64 of the inside blade structure 60. Line 52*a* shows the path of travel of inside edge 52 of the outside blade structure 50. Line 54*a* shows the path of travel of outside edge 54 of the outside blade structure 50.

Again, the purpose of the present invention is to produce a counter flow or multi-directional flow of material within the concrete mixer 10 void area 18 to enhance the mixing action of the concrete materials and to enhance the speed at which these materials are mixed to form concrete and thereby increase the efficiency and speed of the concrete mixer 10 thus saving time in the construction project for which the particular concrete mixer 10 is used. The presently proposed commercial embodiment of the present invention 10 has been found to increase the mixing rate of the concrete by at least 40 percent. The concrete made using the present invention has been found to have a 28-day compressive strength in the range of 5,290 pounds per square inch to 5,620 per square inch. The ASTM standard for 28-day compressive strength is 3500 pound per square inch. Additionally, the presently proposed commercial embodiment of the present invention 10 has been found, in a 12 yard mixer, to be able to thoroughly mix the concrete materials in 35 seconds as opposed to the previous concrete mixing time using the known concrete mixing structure, of 60 seconds.

The above described embodiments of this invention are merely descriptive of its principles and are not to be limited. The scope of this invention instead shall be determined from the scope of the following claims, including their equivalents.

What is claimed is:

1. A concrete mixing mechanism including a mixing shell defining a chamber located therein for receiving material to form concrete, the concrete mixing mechanism comprising:

at least a first blade mechanism and at least a second blade mechanism;

said first blade mechanism and said second blade mechanism being mounted in said chamber and being spaced away from a wall of said chamber;

said first blade mechanism being substantially helical in shape, generally mounted circumjacent to at least one portion of said second blade mechanism, and having a pitch capable of moving at least a portion of said material in a first predetermined direction;

said second blade mechanism having a pitch spatially oriented so that it is capable of moving at least a portion of said material in a second predetermined direction generally counter to said first predetermined direction.

2. The concrete mixing mechanism of claim 1 wherein the first blade mechanism is helical in shape and the second blade mechanism is helical in shape.

3. The concrete mixing mechanism of claim 1 wherein said first blade mechanism comprises a plurality of paddles.

4. The concert mixing mechanism of claim 1 wherein said second blade mechanism comprises a plurality of paddles.

5. The concrete mixing mechanism of claim 1 wherein said shell has an inside surface and said first blade mechanism and said second blade mechanism are coupled to said inside surface of said shell.

6. The concrete mixing mechanism of claim 1 wherein said chamber comprises a passageway extending through said shell.

7. The concrete mixing mechanism of claim 6 wherein said passageway has a charge end opening and a discharge end opening.

8. The concrete mixing mechanism of claim 1 wherein said chamber includes at least one opening.

9. The concrete mixing mechanism of claim 8 wherein said mixing shell includes an inside surface and said first blade mechanism is an outside blade structure located adjacent to said inside surface.

10. The concrete mixing mechanism of claim 9 wherein said second blade mechanism is an inside blade structure located a predetermined distance from said outside blade structure and a predetermined distance from said inside surface of said mixing shell.

11. The concrete mixing mechanism of claim 1 wherein said chamber includes a central axis extending therethrough;

said mixing shell having an inside surface;

said first blade mechanism having an outside edge adjacent to said inside surface and an inside edge located a predetermined distance from said inside surface;

said outside edge of said first blade mechanism circumjacent to said axis and crossing said axis at an angle of approximately 45 degrees;

said inside edge of said first blade mechanism circumjacent to said axis and crossing said axis at an angle of 39 degrees.

12. The concrete mixing mechanism of claim 1 wherein said chamber includes a central axis extending therethrough;

said second blade mechanism having an outside edge and an inside edge;

said outside edge circumjacent to said axis and crossing said central access at an angle of 38 degrees;

said inside edge circumjacent to said axis and crossing said central axis and at an angle of 22 degrees.

13. The concrete mixing mechanism of claim 1 wherein said shell is coupled to a mechanical mechanism capable of rotating said shell in a predetermined direction.

14. The concrete mixing mechanism of claim 1 wherein said chamber has a first predetermined length and said first blade mechanism extends a second predetermined length through said chamber of said first predetermined length;

and said second blade mechanism extends a third predetermined length through chamber;

said third predetermined length being shorter than said second predetermined length.

15. A concrete mixer for mixing a predetermined group of materials to form concrete, said concrete mixer comprising:

a shell structure defining a chamber;

said first mixing mechanism mounted in said chamber;

a second mixing mechanism mounted in said chamber;

said first mixing mechanism and said second mixing mechanism, being spaced away from a wall of said chamber and extending in substantially opposite directions through said chamber;

said first mixing mechanism located circumjacent said second mixing mechanism; said first mixing mechanism having a first pitch and said second mixing mechanism having a second pitch; said first pitch being generally counter to said second pitch so that said first mixing mechanism and said second mixing mechanism are spatially oriented generally opposite each other: whereby the concrete mixer is capable of counterflow mixing of concrete.

16. The concrete mixer of claim 15 wherein the first and second mixing mechanisms comprise a plurality of paddles.

17. A method for mixing concrete using a concrete mixer having a mixing shell structure defining a chamber for receiving materials capable of being mixed to form concrete, the concrete mixer further including a first blade mechanism and a second blade mechanism;

each said blade mechanism being mounted in said chamber; said first blade mechanism being substantially helical in shape and capable of moving at least a portion of said materials in a first predetermined direction;

said second blade mechanism being substantially helical in shape and capable of moving at least a portion of said materials in a second predetermined direction generally counter to said first predetermined direction; said first blade mechanism and said second blade mechanism being circumjacently mounted in said chamber and being spaced away from a wall of said chamber; the method comprising:

pouring the materials into the mixing shell structure;

mixing the materials for a predetermined period of time;

discharging the materials from the concrete mixer.

18. The method of claim 17 wherein the predetermined period of time is less than 36 seconds.

* * * * *